US006312307B1

(12) United States Patent
Dean, II

(10) Patent No.: US 6,312,307 B1
(45) Date of Patent: Nov. 6, 2001

(54) SINGING TOY DEVICE AND METHOD

(76) Inventor: John L. Dean, II, 2205 New Garden Rd., Apt. 3205, Greensboro, NC (US) 27410

( * ) Notice: Subject to any disclaimer, the term of this patent is extended or adjusted under 35 U.S.C. 154(b) by 0 days.

(21) Appl. No.: 09/149,634

(22) Filed: Sep. 8, 1998

(51) Int. Cl.[7] ..... A63H 3/28
(52) U.S. Cl. ..... 446/297; 446/397; 446/72
(58) Field of Search ..... 446/72, 297, 71, 446/73, 76, 268, 270, 369, 397

(56) References Cited

U.S. PATENT DOCUMENTS 4,107,462 * 8/1978 Asija ..... 446/297 X
4,802,879 * 2/1989 Rissman et al. ..... 446/297 X
5,376,038 * 12/1994 Arad et al. ..... 446/297
5,603,652 * 2/1997 Rothschild et al. ..... 446/72 X
5,738,561 * 4/1998 Pracas ..... 446/297

* cited by examiner

*Primary Examiner*—Sam Rimell

(57) ABSTRACT

A singing toy device is disclosed which is well suited for use in water prone environments such as showers and tubs. Specifically, an animal shaped body contains a housing, microphone, switch and battery. The housing and battery are contained within a plastic bag to keep water therefrom. The housing contains two speakers and electrical circuitry within which plays a first recording and then records a child's voice together or separately from the first recording. Subsequently, the second recording is replayed for the child's enjoyment.

18 Claims, 7 Drawing Sheets

SINGING TOY DEVICE AND METHOD

BACKGROUND OF THE INVENTION

1. Field of the Invention

This invention pertains to a device which allows a child to sing along with a first recording on the device thereby creating a second recording which is then played back.

2. Description of The Prior Art And Objectives Of The Invention

Bath time for children can be a trying experience for an adult unless the child is provided with numerous distractions in the form of toys or games. A waterproof radio is one common way parents or adults try to distract the child. Conventional bath toys like rubber duckies or the like may also be used, and several bag-like holders exist which conveniently store such toys between baths while at the same time allowing the toys to dry to prevent mildew or the like.

Similarly, stuffed toys such as TEDDY RUXPIN™, play recordings and allow children to read along with the recited recording. Similarly, some stuffed toys will record a child's voice and play back the recording.

To date, the aforementioned toys have not played a first recording and allowed a child to record his voice with the first recording to thereby create a second recording which is then played back for the child. Similarly, there has not existed a device which would perform said function while allowing use in a water prone environment such as a bath tub, shower or the like.

Thus with the above felt needs in mind, it is an objective of the present invention to provide a toy which plays a first recording and invites a child to sing or speak along with the first recording to create a second recording which is subsequently played back for the child to hear.

It is a further objective of the present invention to provide a device which allows safe playing and recording in a water prone environment such as a tub or shower.

It is still a further objective of the present invention to provide a device which includes a pouch for the storage of toys or other items, such as between baths.

It is yet a further objective of the present invention to provide a device with two waterproof speakers.

It is another objective to provide a method of entertaining children with such a device.

These and other objectives and advantages will become readily apparent to those skilled in the art upon reference to the following detailed description and accompanying drawing figures.

SUMMARY OF THE INVENTION

Disclosed herein is a device well suited for use in showers, tubs or the like. The device comprises preferably an animal-shaped body, such as a kangaroo. The body is preferably suited for hanging vertically, such as disclosed in applicant's earlier U.S. design patent, Des. No. 359,409, which is incorporated by reference herein. The body is made from a material such as nylon, polyester or other materials some of which could be waterproof and includes a rear aperture held closed by a conventional fastener such as a hook-and-loop ply. Enclosed within the body of the device is a housing which contains a pair of waterproof speakers and electrical circuitry. A plurality of wires extend from the housing and provide electrical connections to a switch, a microphone and a conventional nine volt DC battery. In the preferred embodiment, the switch is pressure activated and located in a lower extremity of the body, such as a foot. The microphone is preferably located proximate the center of the body and the battery is contiguous the housing. Both the battery and the housing are selectively sealed within a first waterproof polyethylene bag such as is similar to a conventional ZIP-LOCK™ baggie. The microphone and switch are contained in a second and third waterproof poly bag respectively. These bags are preferably relatively thin, but sturdy polyethylene or similar bags.

In use, the switch activates the electrical circuitry which plays, for example a pre-recorded music or otherwise from the first of the two speakers. At preselected intervals, the microphone activates and records the child's voice together with music or the like from the first speaker. This combined second recording of the music and child's voice is then played through the second speaker so that the child may hear himself singing or speaking along with the music background.

DETAILED DESCRIPTION OF THE PREFERRED EMBODIMENTS AND OPERATION OF THE INVENTION

Figure 2:
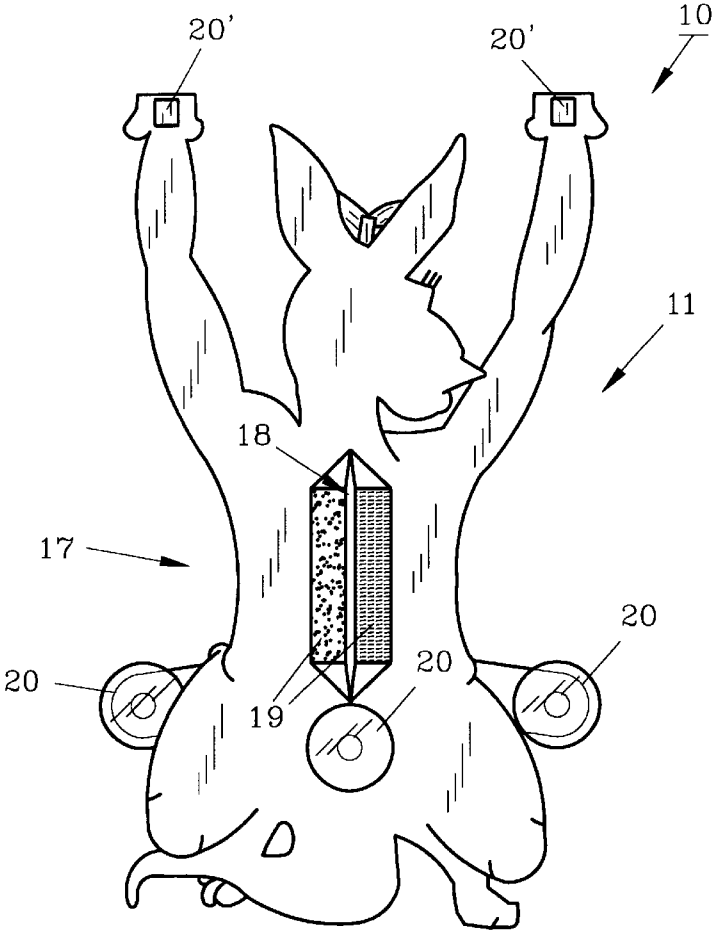
FIG. 2 illustrates a back view of the preferred toy device.
Figure 1:
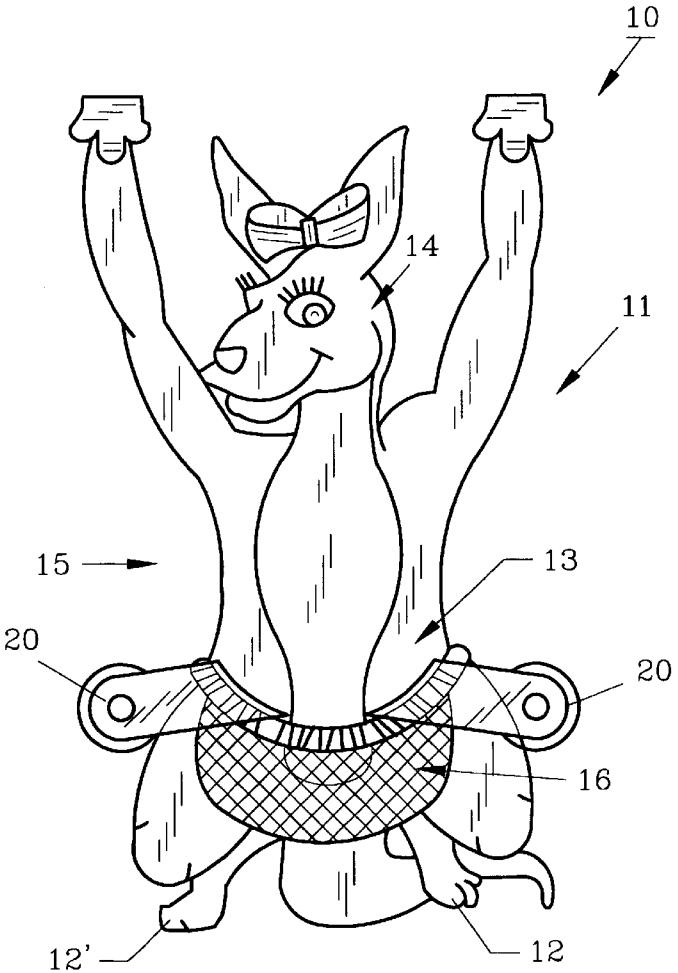
FIG. 1 shows a front view of the preferred toy device.

Turning now to the drawings, specifically FIG. 1 shows singing toy device 10 with body 11. Body 11 is preferably stitched together from a fabric such as nylon or the like. Body 11 includes lower extremities 12 and 12', center 13 and head 14. On front face 15 of body 11 is pouch 16 which may be a net or enclosed fabric pouch. Pouch 16 is well suited to receive bath toys such as rubber ducks or the like. Additionally, pouch 16 may hold shampoo bottles, bubble bath bottles or the like as desired by the user. As seen in FIG. 2, rear face 17 of body 11 includes aperture 18 which is held together by fastener 19 which may be conventional hook-and-loop plies, snaps, a zipper or the like (hook-and-loop plies shown). Additionally suction cups 20 and loops 20' allow body 11 to be mounted on a vertical surface such as a shower wall. Loops 20' may be folded around a towel rod and secured in place with hook and loop fasteners. Body 11 is preferably shaped like an animal such as a kangaroo, but other shapes are also possible.

Figure 3:
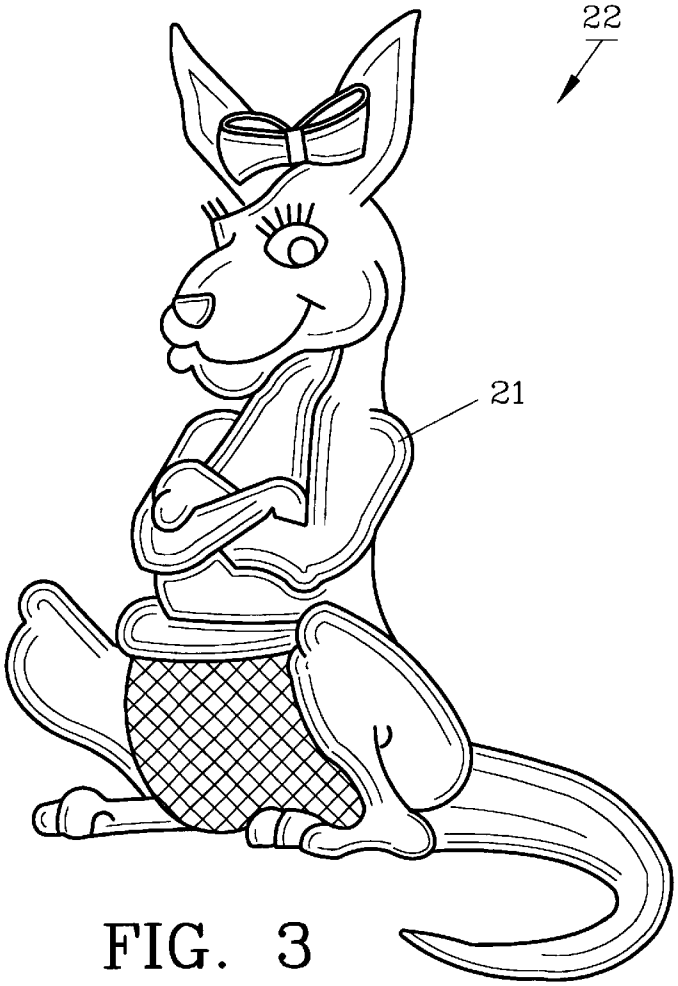
FIG. 3 demonstrates a front perspective of an alternate embodiment.

An alternate embodiment is seen in FIG. 3 as body 11 is generally flat, body 21 of device 22 is more akin to a normal three dimensional stuffed animal. Body 21 is generally more portable than body 11 and not particularly designed for use in water environments although it could be. Body 21 has an aperture (not shown) similar to aperture 18 on body 11.

Figure 4:
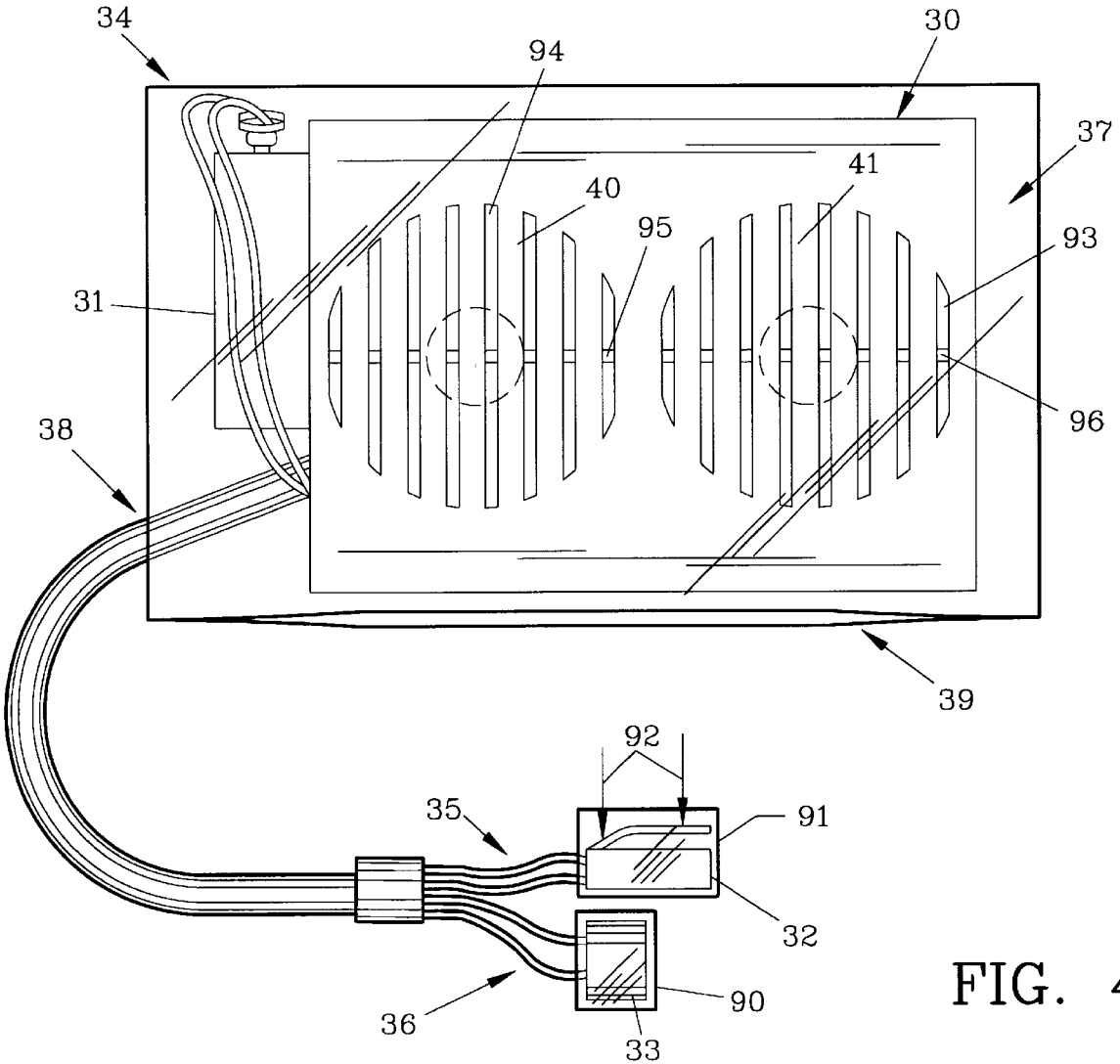
FIG. 4 features a top view of the microphone, switch, battery and housing removed therefrom.

Located within body 11 or 21 is the hardware seen enlarged in FIG. 4, namely housing 30, battery 31, switch 32, and microphone 33. Wiring 34–36 connects battery 31, switch 32 and microphone 33 respectively to housing 30. Switch 32 is a conventional pressure switch and is preferably located in lower extremity 12 of body 11 or the equivalent in body 21. Thus, switch 32 is activated by squeezing lower extremity 12, thus closing the circuit as generally indicated by arrows 92 between battery 31 and the electronics contained within housing 30. Microphone 33 is preferably located proximate center 13 of body 11 or the equivalent area on body 21. Microphone 33 is preferably contained within watertight polyethylene bag 90 and sold under the part number 136573 by Jameco of 1355 Shoreway Road, Belmont Calif. 94002. Switch 32 may be contained within watertight polyethylene bag 91 as needed. Battery 31 and housing 30 are preferably located within waterproof plastic bag 37. Wires 35 and 36 extend from aperture 38 with an appropriate seal made therearound to prevent water from entering bag 37. Bag 37 includes conventional zipper like seal 39 similar to that found on standard polyethylene bags such as sold under the name ZIP-LOCK™. Housing 30 includes first speaker 40 and second speaker 41, which are preferably commercially available speakers sold under part number 135589 by Jameco. Housing 30 is generally rectangular while formed from a rigid polymeric material and defines slots 93 and 94 which allow sound to pass from speakers 40 and 41. Slots 93 and 94 are generally the width of speakers 40 and 41 respectively, but may include cross bars 95 and 96 as shown for additional rigidity. Other shapes are certainly possible, but not preferred. Switch 32 and microphone 33 may be repositioned within body 11 or 21 as desired.

Figure 6:
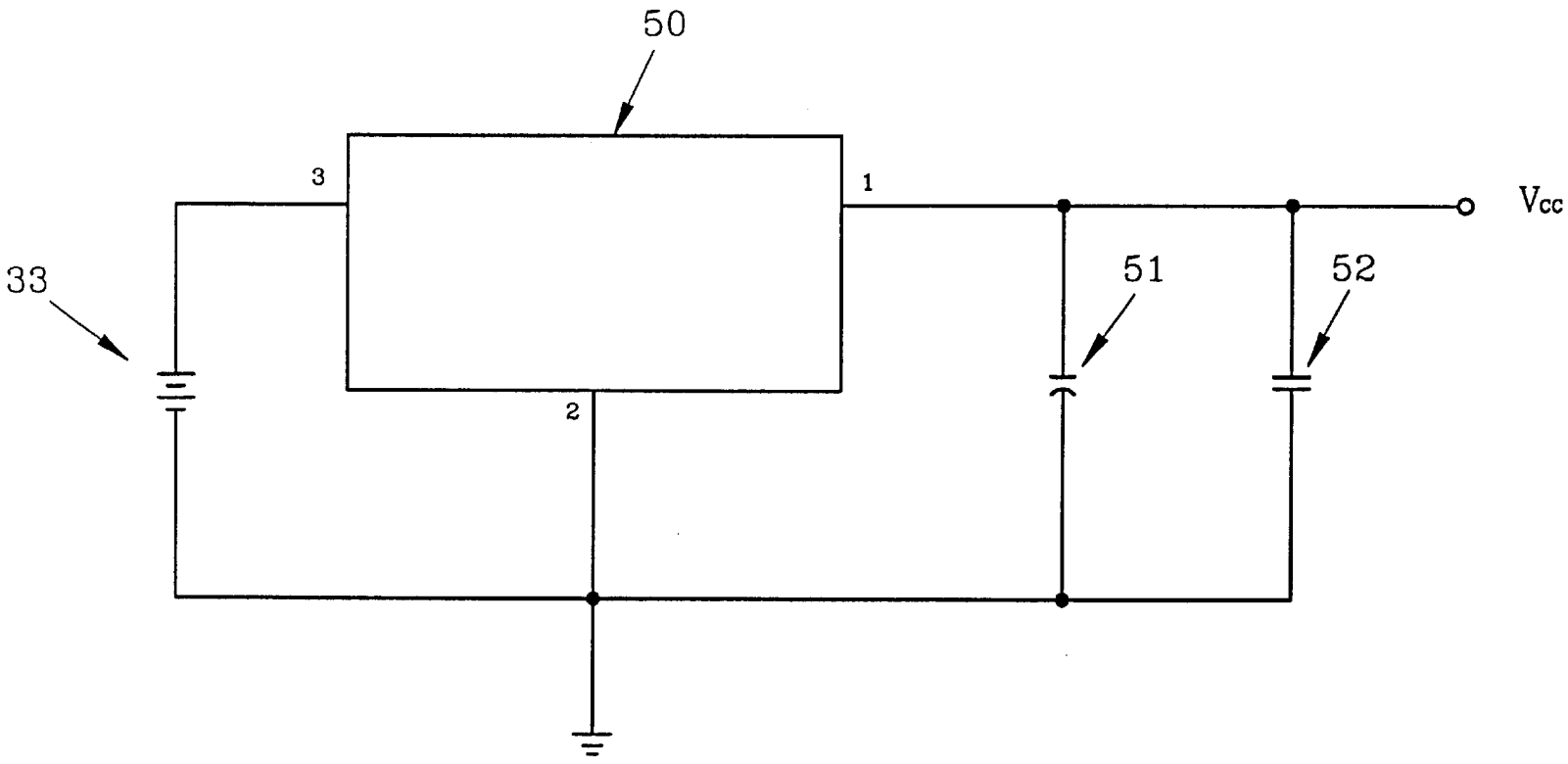
FIG. 6 depicts the electrical schematic for the power supply.

Battery 31 preferably a conventional nine volt battery is connected to LM78L05 chip 50 as seen in FIG. 6. Capacitors 51 and 52 are placed in parallel therewith to provide output voltage Vcc. Capacitors 51 and 52 are preferably a 4.7 $\mu$F and 0.1 $\mu$F capacitors respectively.

Figure 5A:
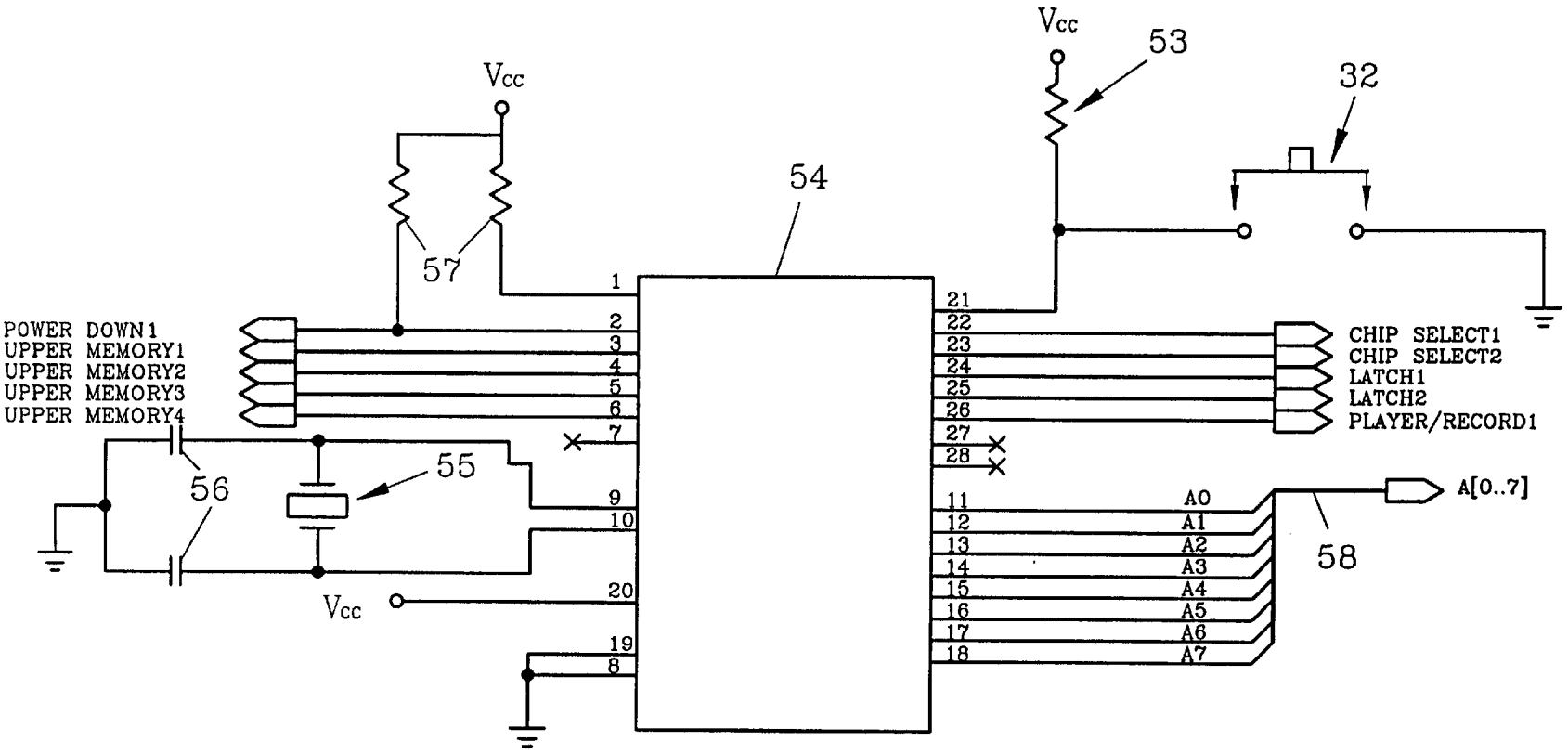
FIGS. 5A–5C picture an electrical schematic of the circuitry contained within the housing.
Figure 5B:
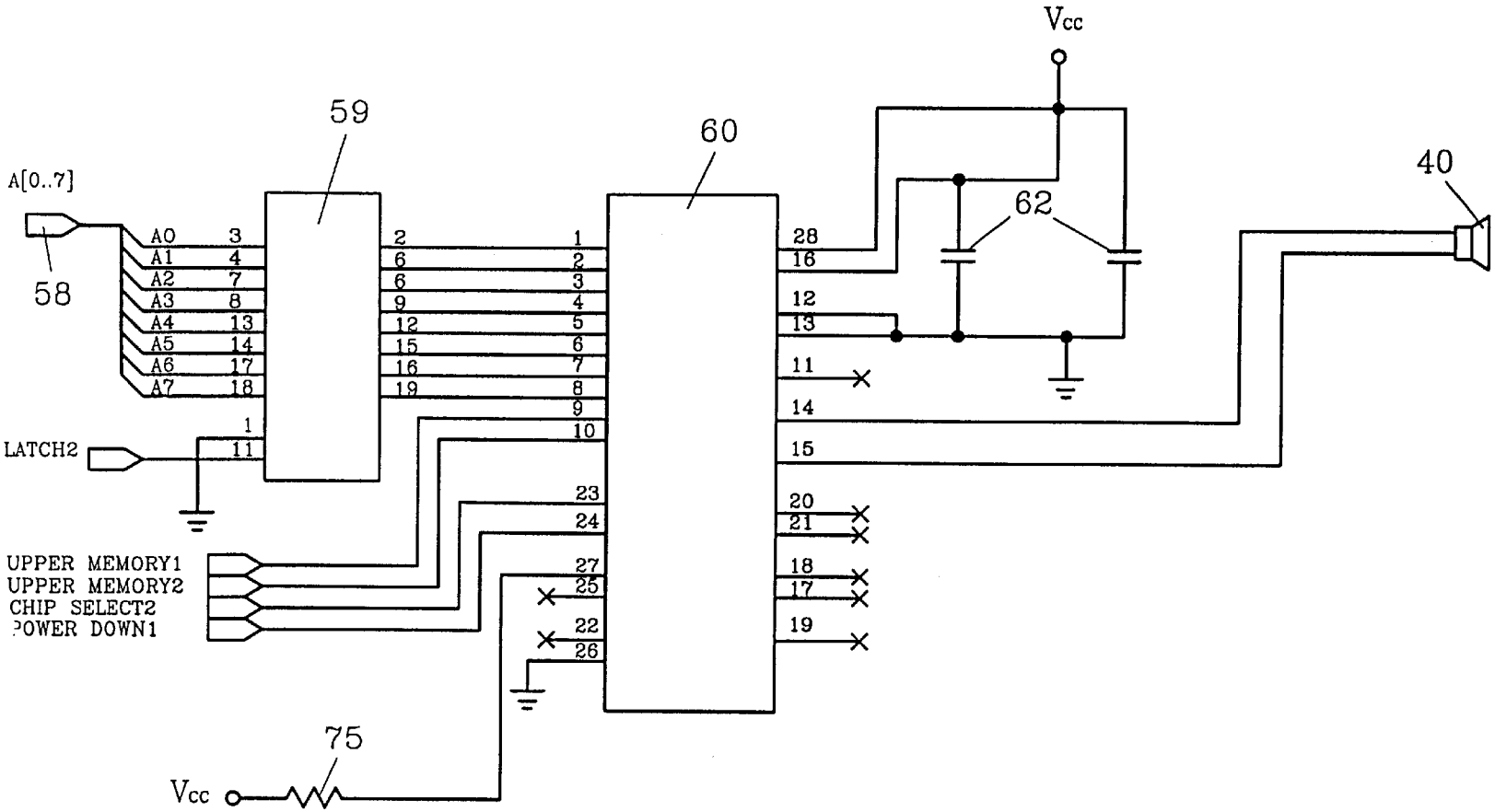
Figure 5C:
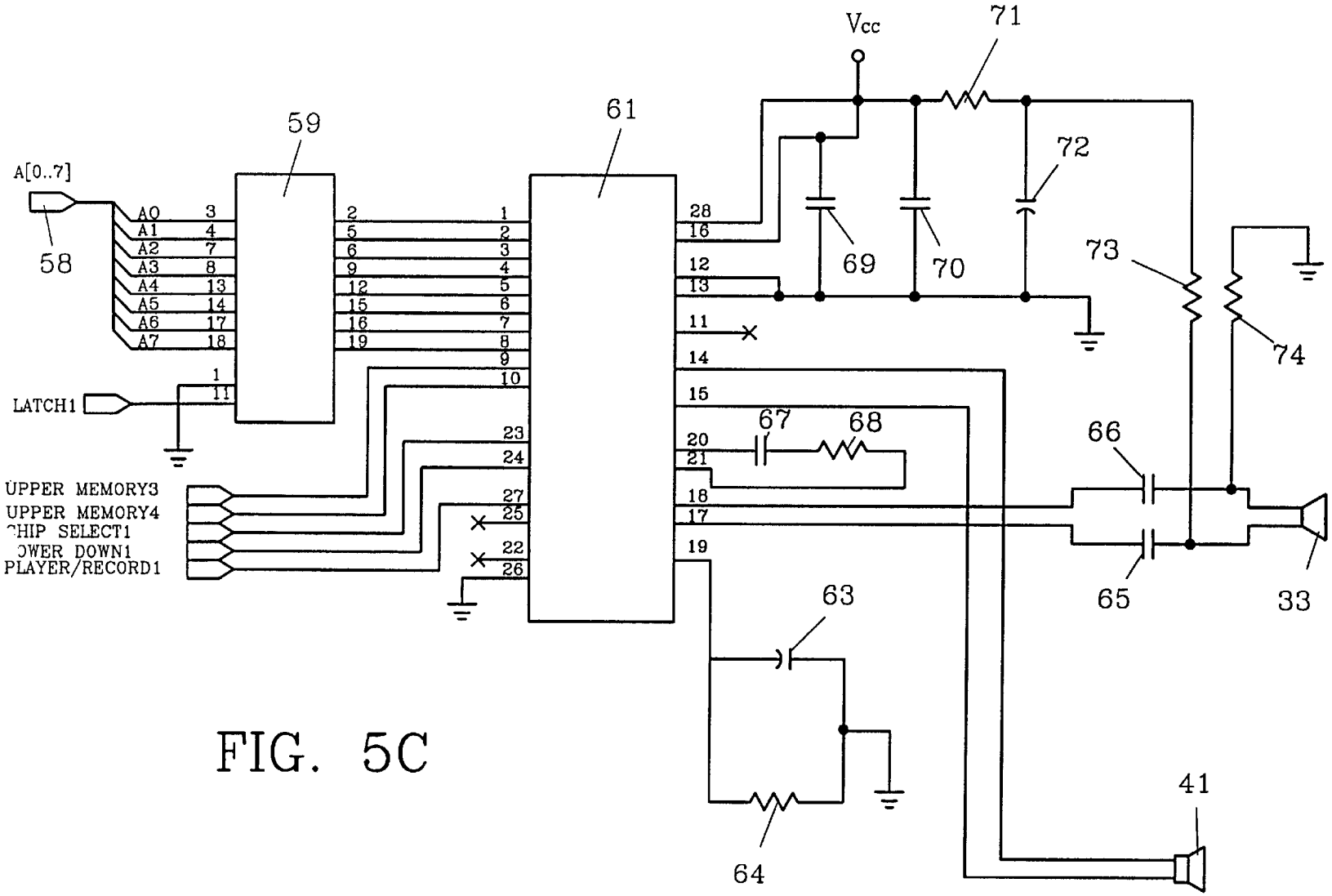

Vcc from battery 31 is utilized where indicated by a Vcc symbol in FIGS. 5A–5C to power the several chips and accompanying electrical circuitry. Specifically, in FIG. 5A, power comes into 4.7 kΩ resistor 53 and connects to switch 32 and thence to PIC16C62 chip 54 which receives input from oscillating crystal 55 controlled by 22 pF capacitors 56. Crystal 55 is preferably set to four MHZ and is commercially available as part number 14592 from Jameco. Power is additionally input to chip 54 through 4.7 kΩ resistors 57. Lead 58 splits and is fed into a pair of 74LS374 chips 59 (FIGS. 5B and 5C) which in turn identically feed into ISD2560 chips 60, 61, which are additionally controlled by feeds directly from chip 54. Additional labels including POWER DOWN1, UPPER MEMORY1, UPPER MEMORY2, UPPER MEMORY3, UPPER MEMORY4, CHIP SELECT1, CHIP SELECT2, LATCH1, LATCH2, and PLAYER/RECORD1 are indicated and connect to chips 59–61 from chip 54 where indicated. These are broken for additional clarity in the figures.

In FIG. 5B, chip 60 controls first speaker 40 and 0.1 $\mu$F capacitors 62. Power is supplied through capacitors 62 and 4.7 kΩ resistor 75. Chip 61, seen in FIG. 5C, controls second speaker 41 and microphone 33. 4.7 $\mu$F capacitor 63 and 470 kΩ resistor 64 in parallel provide an additional connection to ground. 0.1 $\mu$F capacitors 65 and 66 connect microphone 33 to chip 61. 0.1 $\mu$F capacitor 67 and 5.1 kΩ resistor 68 are placed in series between two pins of chip 61. 0.1 $\mu$F capacitors 69 and 70 are connected to 1 kΩ resistor 71 and 220 $\mu$F capacitor 72. Resistors 73 and 74 are 10 kΩ resistors.

In use, switch 32 is pressed in lower extremity 12 thereby actuating the electrical circuitry disclosed in FIGS. 5A–5C and 6 and positioned within housing 30. A prerecorded first recording stored on both chips 60 and 61 is played through first speaker 40 or second speaker 41 as needed. At selected times, the recording will invite the child to sing along with music or with the narrator. Microphone 33 records the child's voice and temporarily stores it on chip 61 creating a second recording. Subsequently, the second recording is played back through second speaker 41 to the child for his entertainment or education. This process can be repeated as desired to elicit different responses from the child. For example the first recording could first ask the child his name, record the child speaking during a break or pause in the first recording and then replay the name; then the first recording could ask the child to spell his name, record, and then replay the spelling; finally the first recording could sing a song and ask the child to sing with music. Microphone 33 would record the music from first speaker 40 and the child's voice and then replay both through second speaker 41 at the conclusion of the first recording or during a pause in the same. Thus, a distracting singing toy is provided for the child. The water proof electronics, microphone and housing allow device 10 to be used in water prone environments such as tubs, showers or the like. Body 21 may be used both in the shower and as a more conventional stuffed toy as desired.

The preceding recitation is provided as an example of the preferred embodiment and is not meant to limit the nature of scope of the present invention or appended claims.

I claim:

1. A singing toy device comprising:

a) a body;

b) electrical circuitry, said electrical circuitry disposed in said body, said electrical circuitry storing a first recording;

c) a microphone, said microphone electrically connected to said circuitry, said microphone enabling the creation of a second recording in said electrical circuitry;

d) a first speaker, said first speaker electrically connected to said circuitry so as to only play said first recording; and e) a second speaker, said second speaker electrically connected to said circuitry so as to only play said second recording.

2. The device of claim 1 wherein said body is kangaroo shaped.

3. The device of claim 1 further comprising a switch, said switch electrically connected to said circuitry.

4. The device of claim 1 further comprising a pouch, said pouch attached to said body for storing items therein.

5. The device of claim 1 wherein said body further comprises a pouch.

6. The device of claim 1 wherein said device is water proof.

7. A method of entertaining a child, said method comprising the steps of:

a) providing a device in a bathing area comprising a body with a first speaker and a second speaker and a first recording stored on electrical circuitry;

b) playing said first recording only on said first speaker;

c) capturing the voice of the child on a second recording; and d) playing back said second recording on said second speaker.

8. The method of claim 7 further comprising the step of capturing a portion of the first recording on a second recording simultaneously with the step of capturing the voice of the child.

9. The method of claim 8 further comprising the step of playing said second recording containing both the child's voice and said portion of said first recording.

10. The method of claim 7 wherein playing back said second recording comprises playing back said second recording through a second speaker.

11. The method of claim 7 further comprising the step of turning on said device by depressing a switch.

12. A device comprising;

a) a body;

b) a housing, said housing disposed in said body;

c) a first speaker, said speaker positioned on said housing;

d) means to prevent water from reaching said housing, said preventing means surrounding said housing;

e) a first recording, said first recording selectively played through said first speaker;

f) a microphone, said microphone electrically connected to said speaker; and g) a second speaker; wherein said first is configured to only play said first recording, said microphone creates a second recording and said second speaker is configured to only play said second recording.

13. The device of claim 12 wherein said second recording comprises a portion of said first recording.

14. The device of claim 12 wherein said body is made from cloth.

15. The device of claim 12 wherein said body is shaped like a kangaroo.

16. The device of claim 12 wherein said housing is formed from a rigid polymeric material.

17. The device of claim 12 further comprising a pouch, said pouch attached to said body, means to mount said body, said mounting means attached to said body.

18. The device of claim 17 wherein said mounting means comprises a suction cup.

* * * * *